US008943945B1

(12) United States Patent
Collins

(10) Patent No.: US 8,943,945 B1
(45) Date of Patent: Feb. 3, 2015

(54) ARTICLE THROWING SYSTEM

(71) Applicant: Michael Collins, Blanchard, OK (US)

(72) Inventor: Michael Collins, Blanchard, OK (US)

( * ) Notice: Subject to any disclaimer, the term of this patent is extended or adjusted under 35 U.S.C. 154(b) by 0 days.

(21) Appl. No.: 13/927,902

(22) Filed: Jun. 26, 2013

(51) Int. Cl.
*F41J 9/18* (2006.01)
*F41B 6/00* (2006.01)
*F41B 7/00* (2006.01)

(52) U.S. Cl.
CPC .... *F41B 6/00* (2013.01); *F41B 7/00* (2013.01)
USPC ..... 89/8; 124/3; 124/16

(58) Field of Classification Search
CPC ..... F41J 9/18–9/32
USPC ..... 124/3, 7, 16–17, 42, 46; 89/8
See application file for complete search history.

(56) References Cited

U.S. PATENT DOCUMENTS 2,025,903 A * 12/1935 Roth ..... 124/8
2,135,603 A * 11/1938 Roth ..... 124/8
2,955,823 A * 10/1960 Chanko ..... 124/7
3,130,717 A * 4/1964 De Lossy et al. ..... 124/1
3,779,227 A * 12/1973 Scott ..... 124/16
3,971,357 A * 7/1976 LaPorte et al. ..... 124/8
4,111,179 A 9/1978 Hashimoto
4,220,130 A * 9/1980 Glover et al. ..... 124/7
4,391,264 A * 7/1983 Abraham et al. ..... 124/50
5,562,282 A * 10/1996 Stevenson ..... 124/7
6,176,229 B1 * 1/2001 Patenaude ..... 124/8
6,276,350 B1 * 8/2001 Davey ..... 124/8
6,601,574 B1 8/2003 Cole
2013/0269667 A1 * 10/2013 Laporte et al. ..... 124/6

* cited by examiner

*Primary Examiner* — Troy Chambers
*Assistant Examiner* — Benjamin Gomberg
(74) *Attorney, Agent, or Firm* — Smith Moore Leatherwood LLP; Thomas W. Epting; Matthew S. Bedsole

(57) ABSTRACT

An apparatus for propelling a projectile. A support structure has a propulsion structure pivotally connected thereto and is movable between an armed position and a disarmed position. In impulse delivery arrangement delivers an impulse force that propels the propulsion structure from the armed position to the disarmed position. A channel is configured to cause the projectile to be in biased contact with the propulsion structure upon the propulsion structure being in the armed position. Wherein, upon the impulse delivery arrangement delivering an impulse force propelling the propulsion structure from the armed position, the propulsion structure propels the projectile through and outwardly from the channel. The channel is selectively adjustable in X, Y, and Z planes to selectively guide the projectile in a generally predetermined direction, upon the projectile being propelled from the channel.

18 Claims, 13 Drawing Sheets

ARTICLE THROWING SYSTEM

FIELD

The present disclosure relates generally to methods and configurations for throwing or otherwise impelling an article. More specifically, certain aspects of the disclosure relate to apparatuses, methods and systems for throwing an article such as a disk or other item for use as a target for shooting and/or for other purposes.

BACKGROUND

In a trapshooting, a machine or a hand-held device may be used to throw a clay target, or "pigeon," or "bird," downrange from a shooter. The shooter typically tries to shoot the bird as it flies through the air, or, in some instance, as it rolls and/or bounces across the ground.

While devices exist for throwing clay targets, it may be desirable to throw downrange relatively small and/or lighter weight items (as compared to typical clay targets), perhaps a shorter distance (as compared to typical trapshooting), particularly if smaller and/or less powerful rounds are being used in the shooter's firearm (such as snake-shot, rat-shot, low-powered shotgun cartridges, etc.). As a result of using smaller targets and smaller and/or less powerful rounds, less land may be necessary for enjoying target shooting, and also, the noise generated during such shooting may potentially be lessened.

Further limitations and disadvantages of conventional and traditional approaches may become apparent to one of skill in the art, through comparison of such systems with teachings and example implementations set forth in the present disclosure.

SUMMARY

It would be desirable to provide an apparatus and method that address at least some of the issues discussed above, as well as other potential issues. Moreover, it would be beneficial to furnish an apparatus for throwing relatively lightweight objects.

Accordingly, apparatuses and methods are disclosed for throwing an article substantially as shown in and/or described in connection with at least one of the figures, and as set forth more completely in the claims.

More specifically, examples of the present disclosure are generally directed to apparatuses, and methods for throwing an article for use as a target for shooting, articles used in training of animals (such as hunting dogs), and/or articles used in recreational endeavors, games, sports, etc., and/or articles used in agricultural, industrial, commercial, construction, or military sectors, etc.

In one example implementation, an apparatus is disclosed for launching a projectile, with the apparatus including a support structure and a propulsion structure pivotally connected to the support structure and movable between an armed position and a disarmed, or stop, position. Means are provided for delivering an impulse force that propels the propulsion structure from the armed position to the disarmed position. A channel is configured to cause the projectile to be biasing or pressing against the propulsion structure upon the propulsion structure being in the armed position, wherein upon the means for delivering an impulse force propelling the propulsion structure from the armed position, the propulsion structure propels the projectile through and outwardly from the channel.

Additionally, an example implementation includes a method for launching a projectile, including: (a) providing a propulsion structure pivotally connected to a support structure and movable between an armed position and a disarmed position; (b) configuring the propulsion structure to be in the armed position; (c) providing a channel for holding and discharging a projectile from an exit portion of the channel; (d) inserting a projectile in the channel; (e) biasing or pressing the projectile against the propulsion structure upon the propulsion structure being in the armed position; and (I) delivering an impulse force that propels the propulsion structure from the armed position to the disarmed position such that the propulsion structure propels the projectile through and outwardly from the channel.

In a further implementation, an apparatus is provided for launching a projectile, and includes a support structure and a propulsion structure pivotally connected to the support structure and movable between an armed position and a disarmed position. The propulsion structure has a generally arcuate edge portion, and the arcuate edge defines at least one receptacle. A retainer is actuatable to selectively engage the receptacle to retain the propulsion structure in the armed position, and means are provided for delivering an impulse force that propels the propulsion structure from the armed position to the disarmed position. A channel is configured to cause the projectile to be in biased or pressing contact with the propulsion structure upon the propulsion structure being in the armed position, wherein upon the means for delivering an impulse force propelling the propulsion structure from the armed position, the propulsion structure propels the projectile through and outwardly from the channel. The channel has a first portion proximate the propulsion structure, when the propulsion structure is in the armed position, and an exit portion distal from the first portion. The exit portion is configured to allow the discharge of the projectile from the channel upon the propulsion structure propelling the projectile through the channel. The channel is inclined upwardly from the first portion to the second portion thereof with respect to horizontal, and the arcuate edge portion is configured to move through the channel as the propulsion structure moves between the armed position and the disarmed position. A first adjustor is connected to the support structure and is configured to selectively move the exit portion of the channel within a first plane. A second adjustor is connected to the support structure and is configured to selectively move the exit portion of the channel within a second plane, wherein the second plane is generally perpendicular to the first plane, and a third adjustor is connected to the support structure and configured to selectively move the exit portion of the channel within a third plane, wherein the third plane is perpendicular to at least one of the first plane and the second plane.

In other aspects of the disclosure, a method, system and/or apparatus are provided for throwing, propelling, impelling, and/or launching an article generally from a resting position.

The features, functions and advantages discussed herein may be achieved independently in various example embodiments or may be combined in yet other example embodiments further details of which may be seen with reference to the following description and drawings.

BRIEF DESCRIPTION OF THE DRAWINGS

Figure 1:
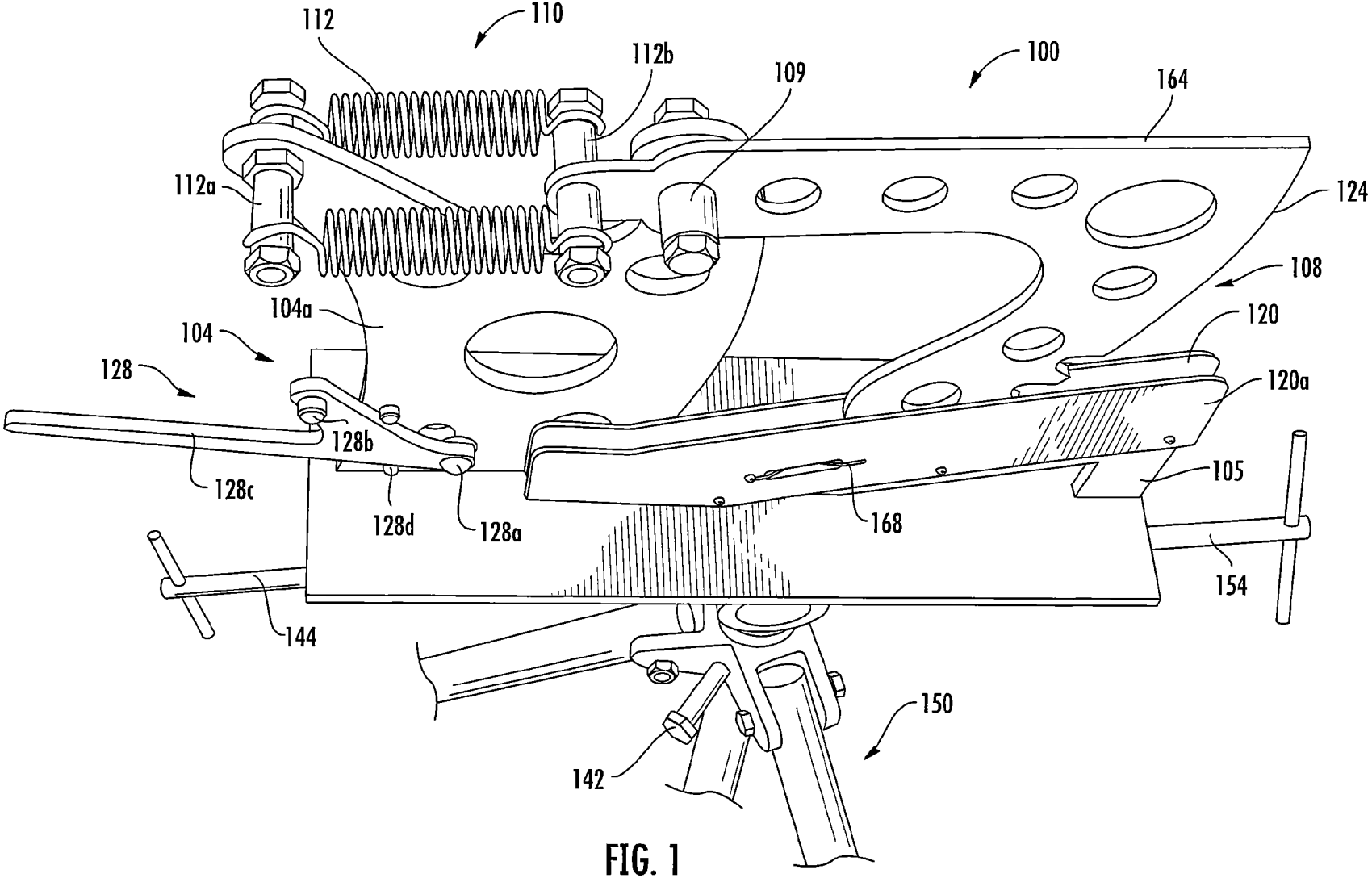
Figure 2:
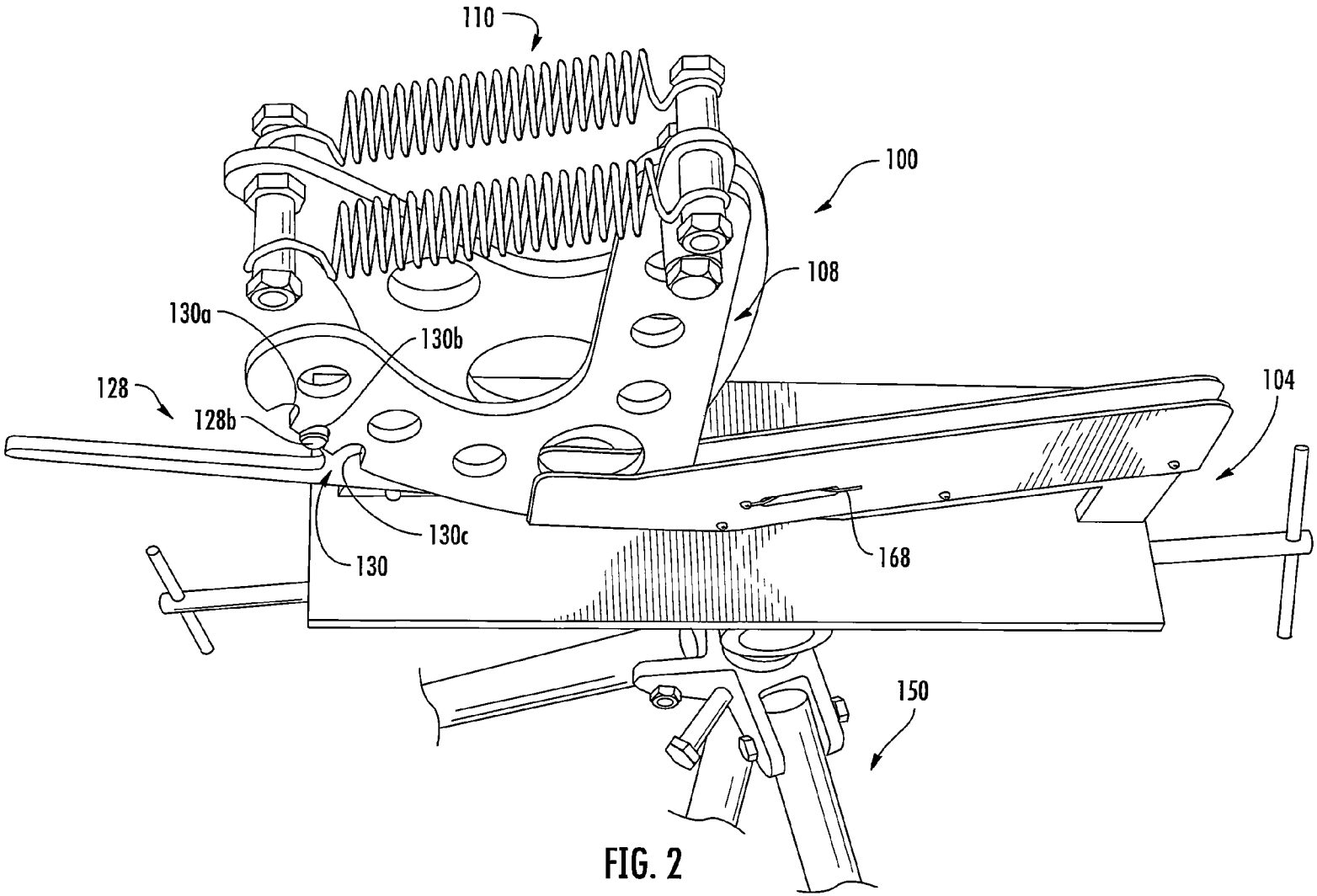
Figure 3:
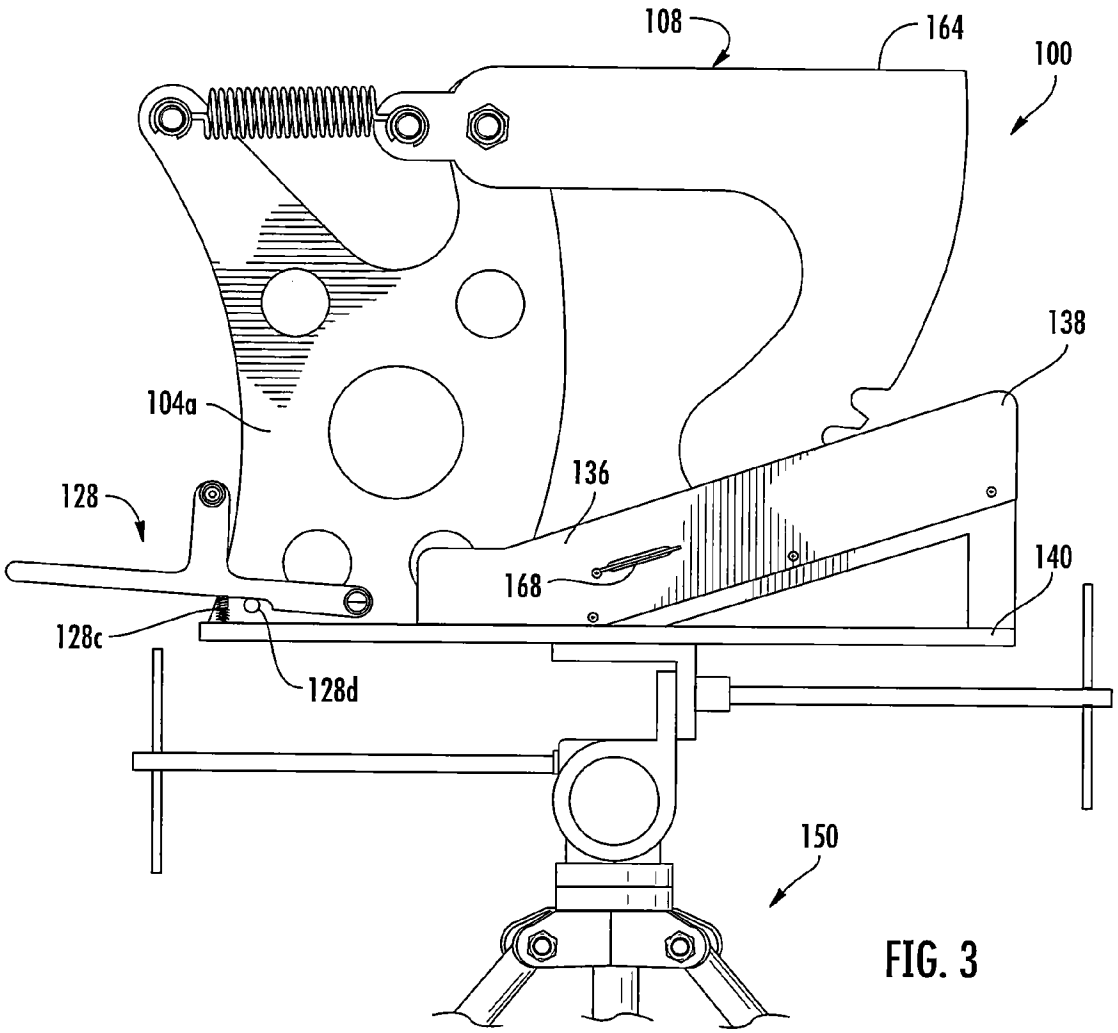
Figure 4:
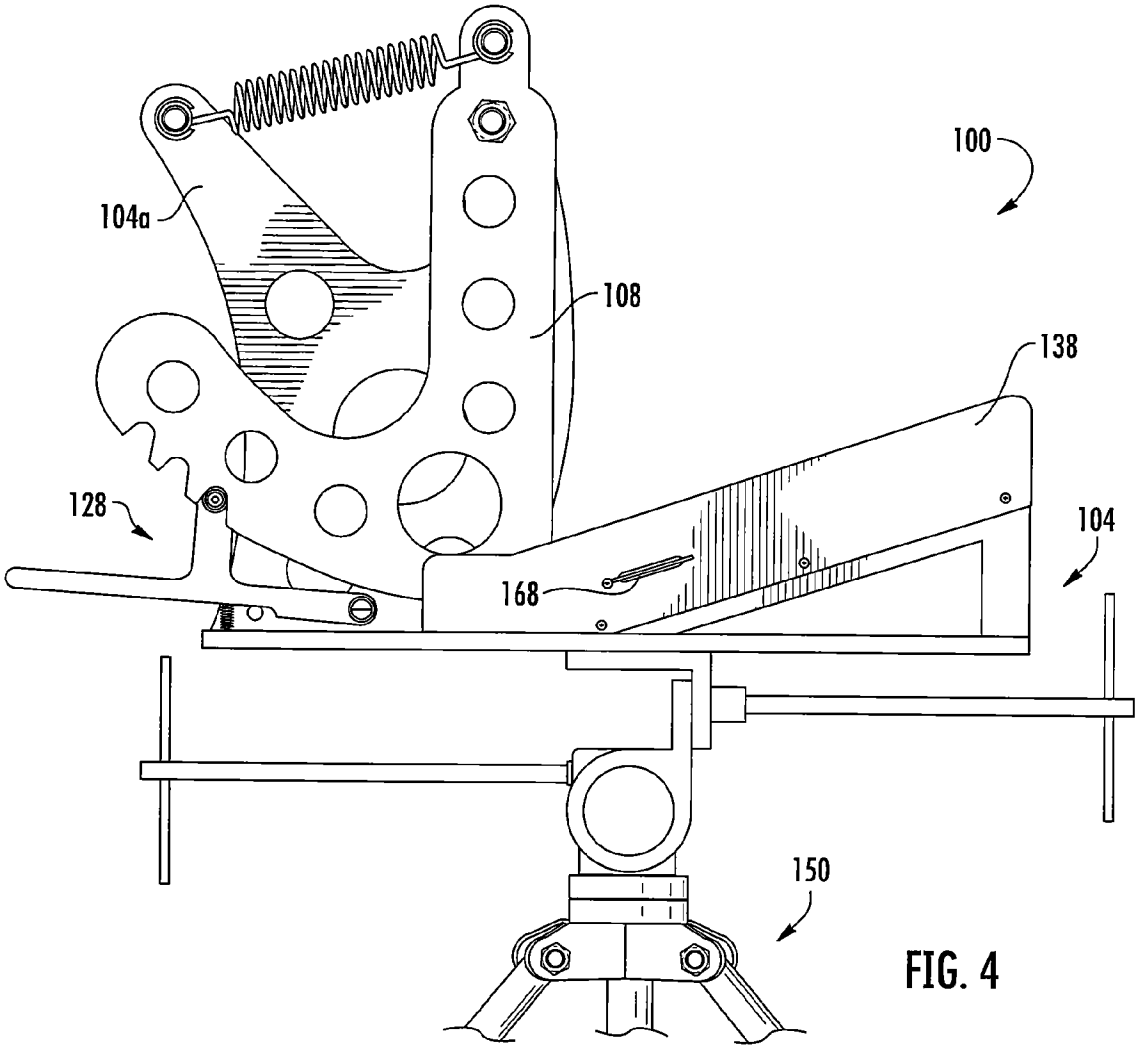
Figure 6:
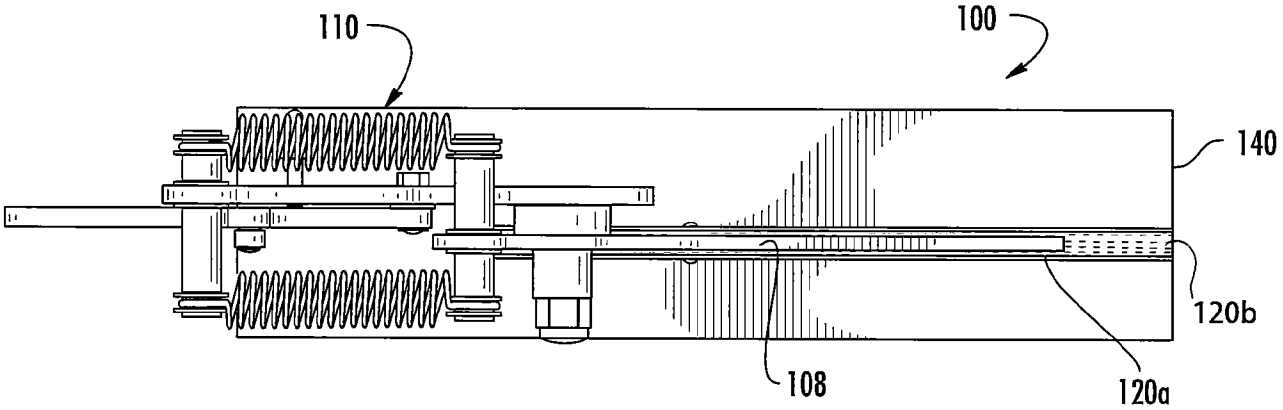
Figure 5:
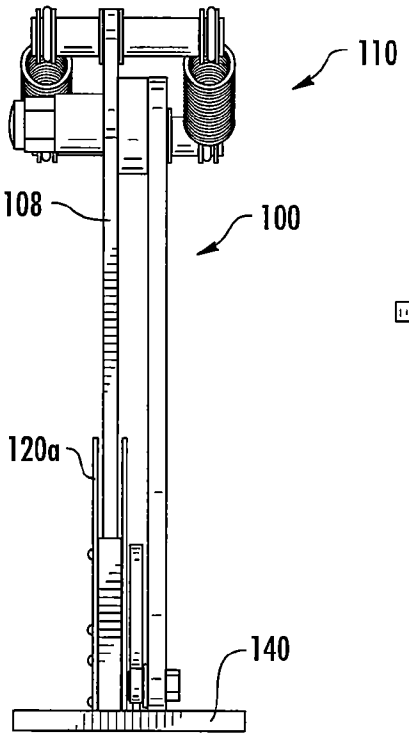
Figure 7:
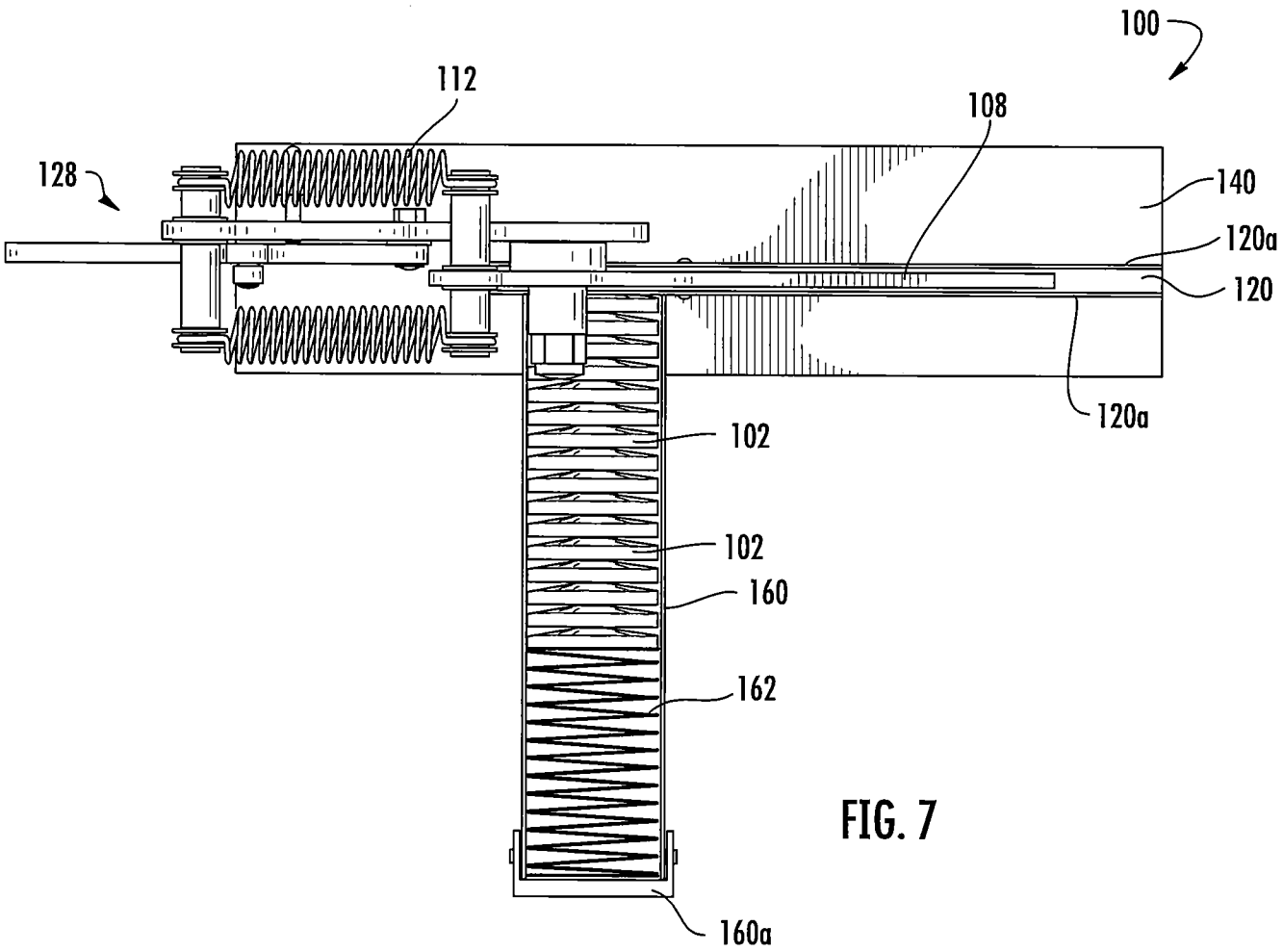
Figure 8:
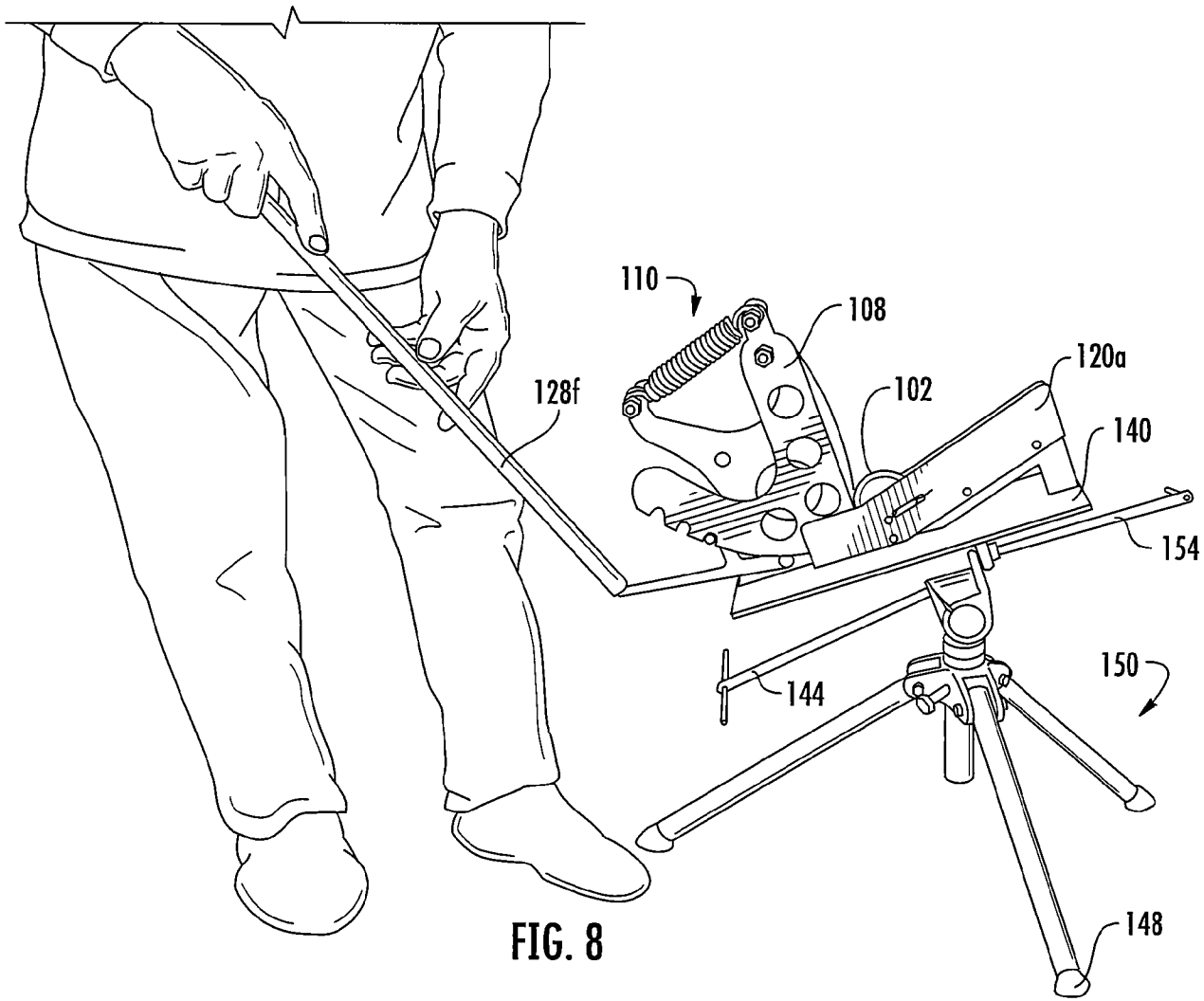
Figure 10:
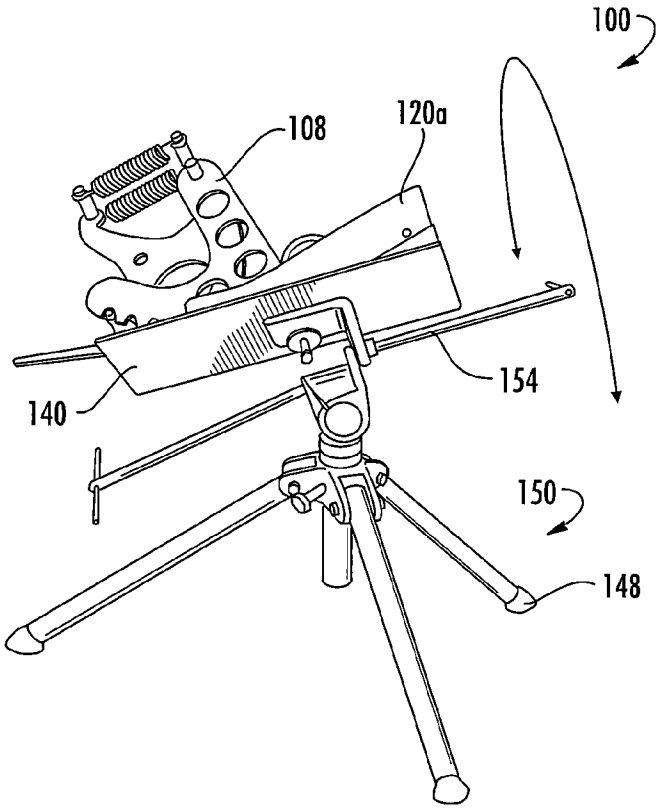
Figure 9:
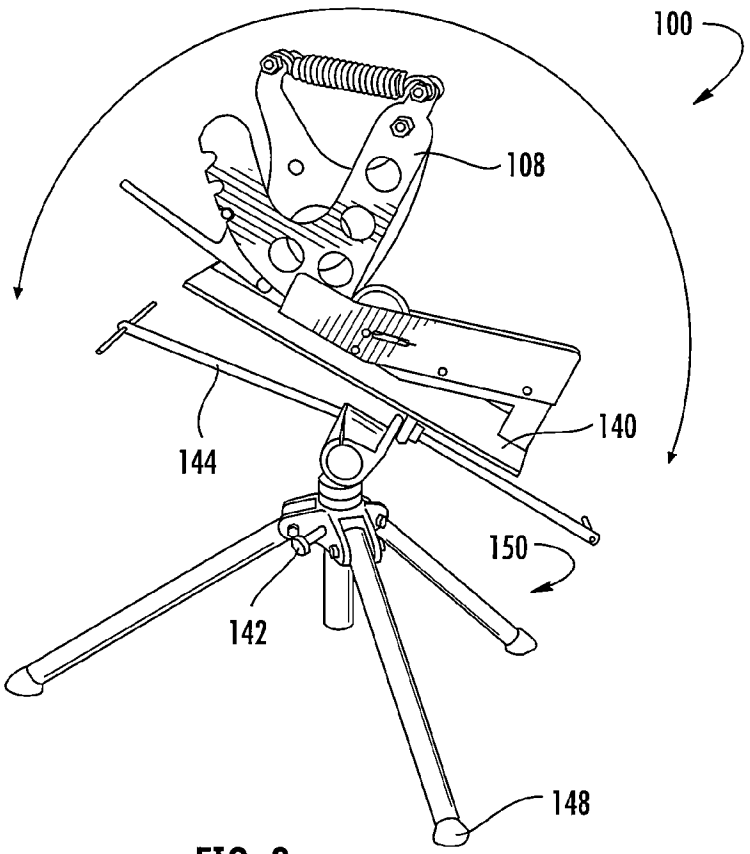
Figure 11:
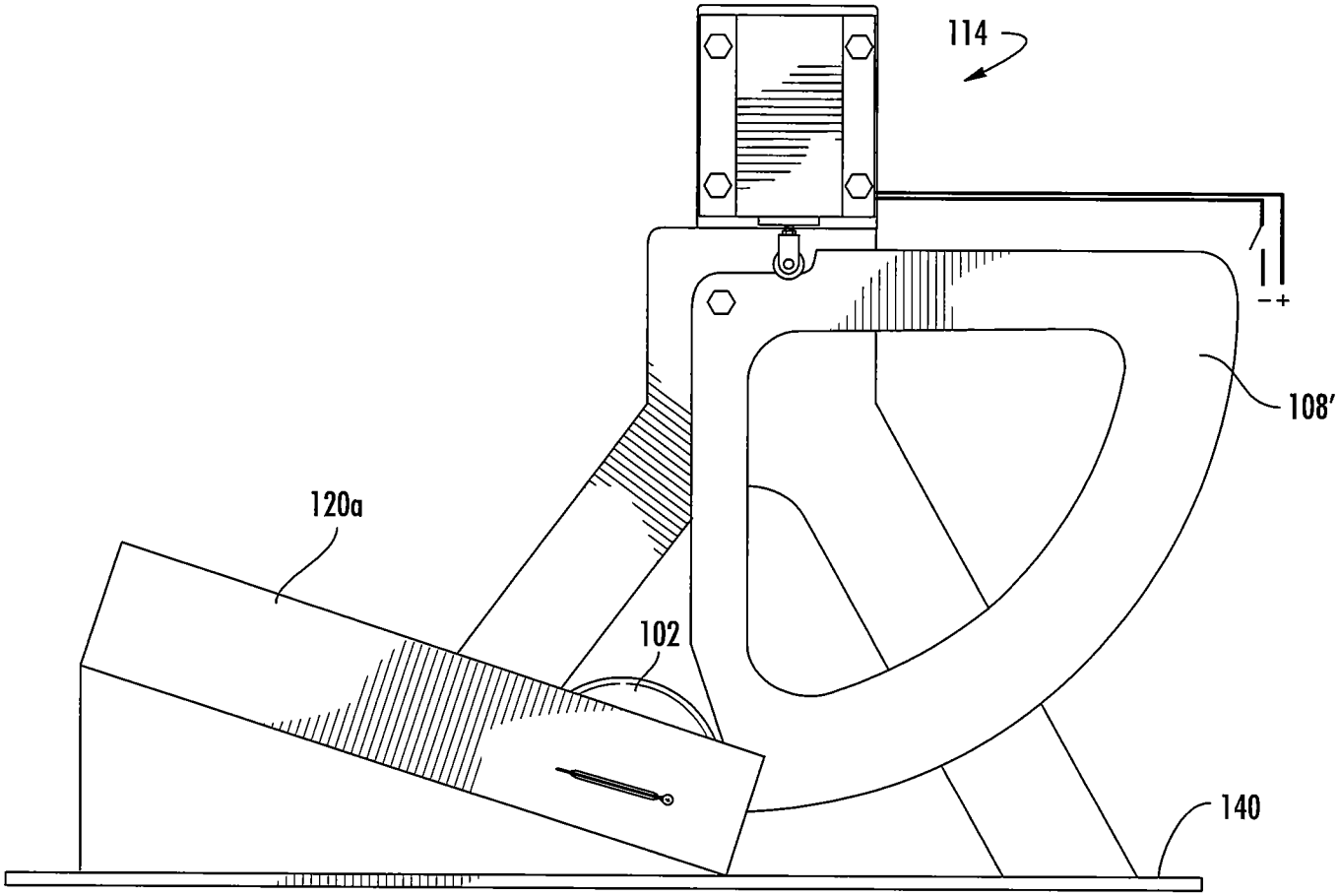
Figure 12:
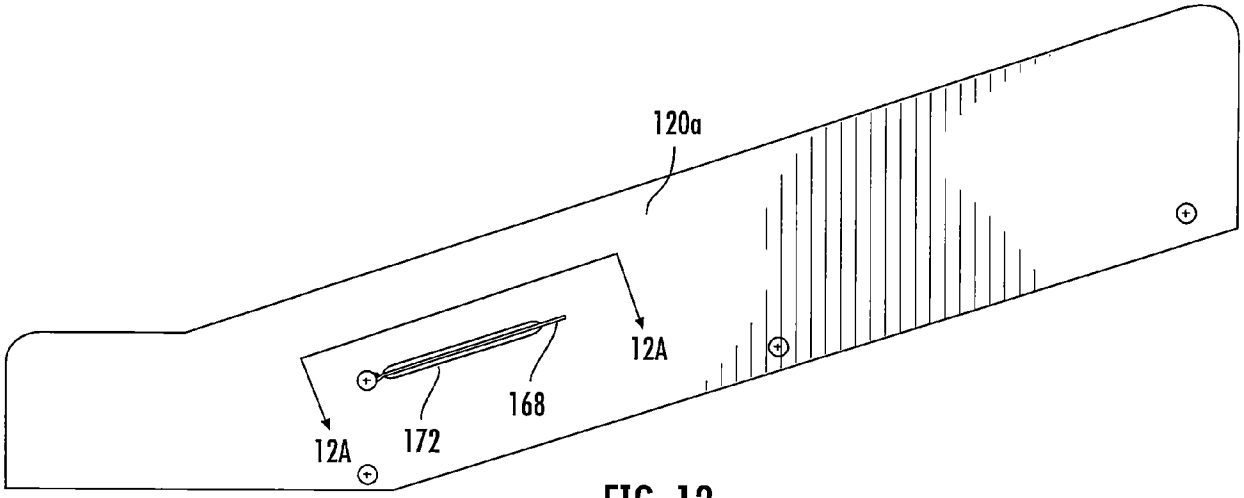
Figure 12B:
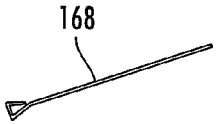
Figure 12C:
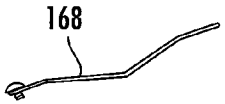
Figure 12A:
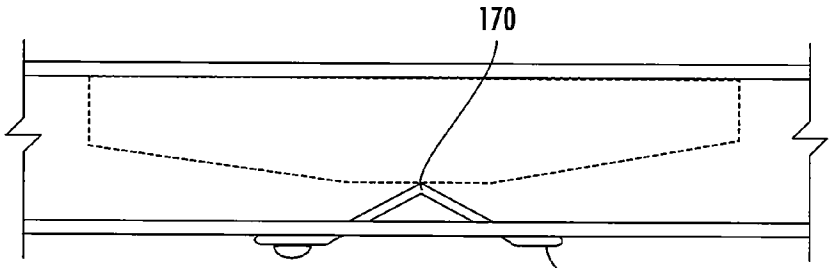
Figure 13:
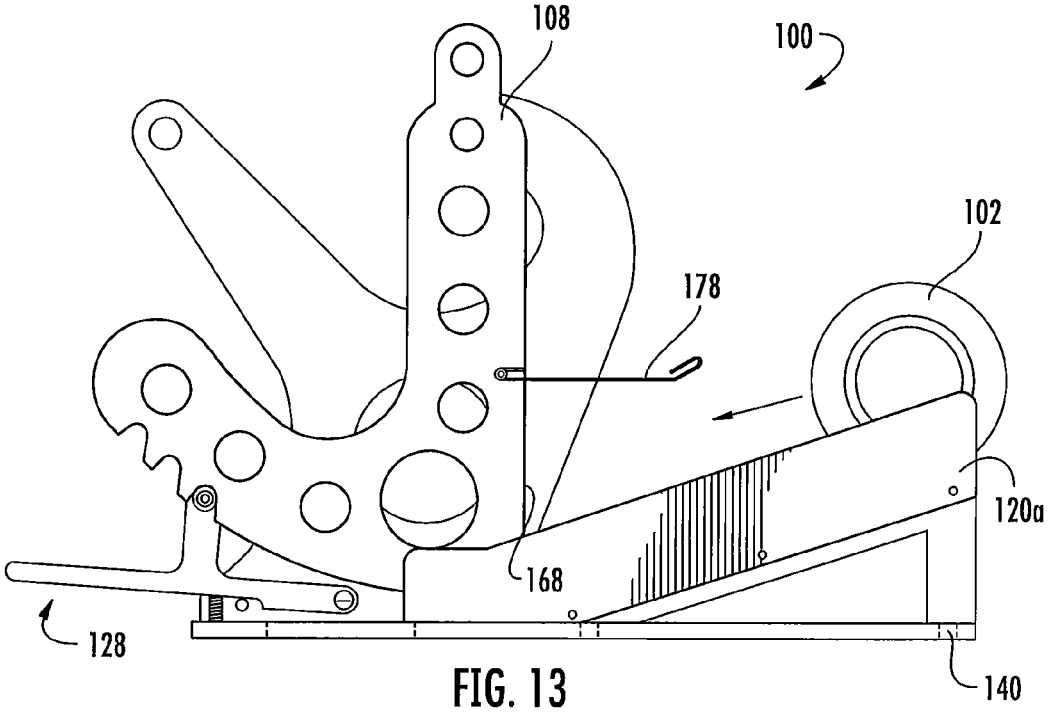
Figure 14:
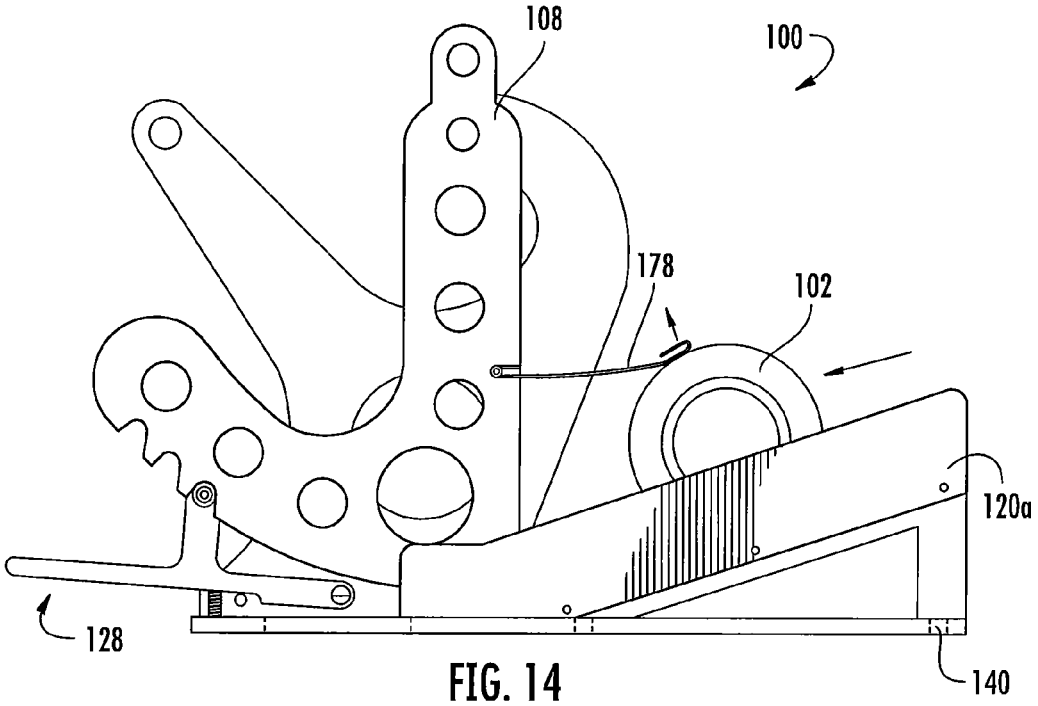
Figure 15:
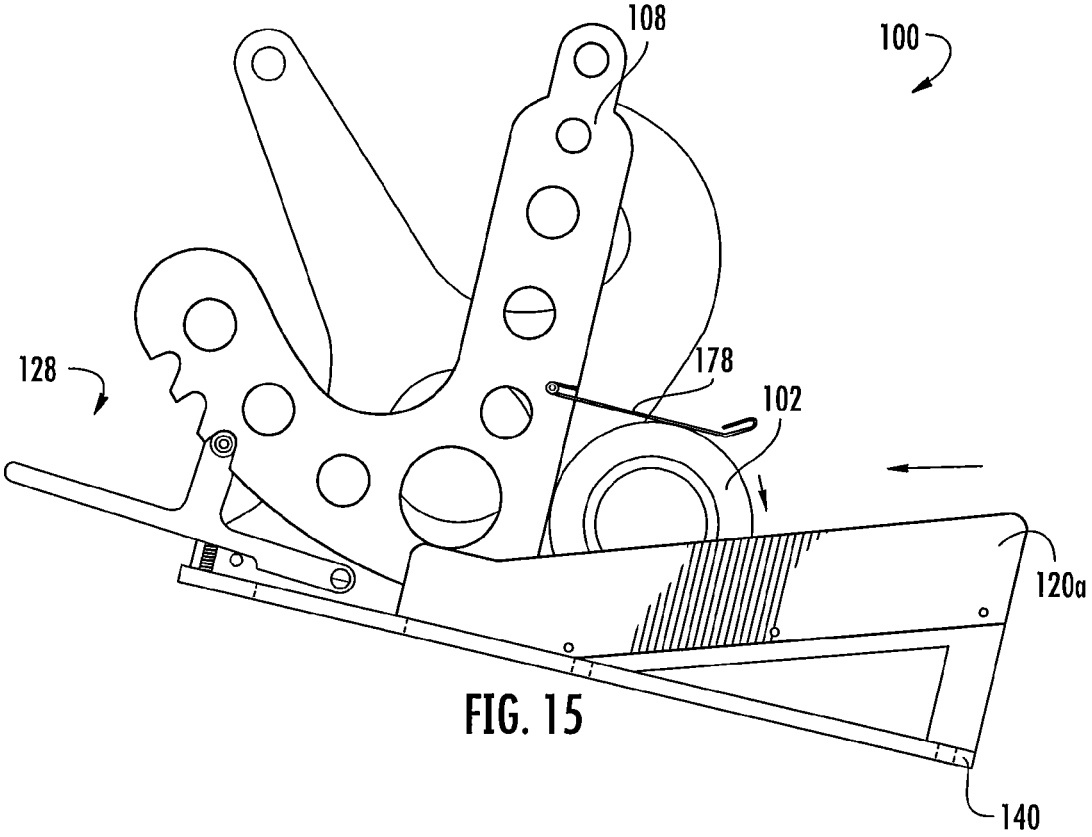

Having thus described exemplary aspects of the disclosure in general terms, reference will now be made to the accompanying drawings, which are not necessarily drawn to scale, and wherein:

FIG. 1 illustrates an example projectile launching, or article throwing, apparatus with a propulsion structure in a release, or disarmed, position;

FIG. 2 illustrates an example article throwing apparatus with a propulsion structure in a cocked, or armed, position;

FIG. 3 illustrates an elevational view of an example article throwing apparatus with a propulsion structure in a disarmed position;

FIG. 4 illustrates an elevational view of an example article throwing apparatus with a propulsion structure in an armed position;

FIG. 5 is a front elevational view of the example article throwing apparatus shown in FIG. 4, with a propulsion structure in the armed position;

FIG. 6 is a plan view of an example article throwing apparatus with a propulsion structure shown in a disarmed position;

FIG. 7 is a plan view of another example of an example article throwing apparatus, and includes a holder, or cartridge, for carrying multiple projectiles and for dispensing such projectiles to a chute or channel through which the propulsion structure passes as it moves between the armed and disarmed positions;

FIG. 8 is a perspective view of an example article throwing apparatus constructed in accordance with the present invention being activated by a user, for causing the propulsion structure to move from the armed to the disarmed position;

FIGS. 9 and 10 illustrate an example projectile launching apparatus and the degrees of freedom of movement of a propulsion structure and channel of such apparatus;

FIG. 11 is another example of an article throwing apparatus having an automatic actuator for causing, or actuating, a propulsion structure to move from a disarmed position to an armed position and/or from an armed position to a disarmed position;

FIG. 12 is an elevational view of a channel usable in an example article throwing apparatus;

FIG. 12A is a partial plan view of the channel illustrated in FIG. 12;

FIG. 12B is a plan view of a resilient member used in the channel illustrated in FIG. 12;

FIG. 12C is an elevational view of the resilient member shown in FIG. 12B; and FIG. 13 is a side elevational view of another example implementation of an article throwing apparatus, including an example biased engagement member that is engagable with a projectile, shown in a channel approaching a propulsion structure;

FIG. 14 is a side elevational view of the biased engagement member shown in FIG. 13, engaged with a projectile in the channel; and FIG. 15 is a side elevational view of the biased engagement member shown in FIG. 13, engaged with a projectile in the channel, the projectile being in biased or pressing contact against the propulsion structure, and the article throwing apparatus being tilted at an angle.

DETAILED DESCRIPTION

Some examples of the present disclosure will now be described more fully hereinafter with reference to the accompanying drawings, in which some, but not all examples of the disclosure are shown. Indeed, various aspects of the disclosure may be embodied in many different forms and should not be construed as limited to the examples set forth herein. Rather, these examples are provided so that this disclosure will be thorough and complete and will fully convey the scope of the disclosure to those skilled in the art. Like reference numerals refer to like elements throughout.

As used herein, "and/or" means any one or more of the items in the list joined by "and/or". As an example, "x and/or y" means any element of the three-element set {(x), (y), (x, y)}. Additionally, as used herein, the term "exemplary" means serving as a non-limiting example, instance, or illustration. Moreover, as used herein, the term, for example, or "e.g.," introduces a list of one or more non-limiting examples, instances, or illustrations.

Referring more particularly to the drawings, examples of the present disclosure include apparatus, methods and systems for throwing an article, or projectile, which may be described in the context of throwing a moving target in a shooting activity. This target, or projectile, could be an article, such as a "pigeon" or "clay pigeon," or any other suitable article, such as a cracker, dog biscuit, etc.

Turning to FIG. 1 of the drawings, an article throwing apparatus, generally 100, is disclosed for launching a projectile 102 (FIG. 8). The apparatus 100 includes a support structure, generally 104, and a propulsion member, or structure, generally 108, pivotally connected to the support structure 104 by a fulcrum pivot 109 and movable between an armed position (FIGS. 2, 4, 5, 8, 9-11, and 15) and a release or disarmed position (FIGS. 1, 3, 6, and 7).

A biasing configuration, generally 110, which may include springs such as coil springs 112 (FIGS. 1-10 and 13-15) or other springs, elastic members, magnetic structures, etc. (none shown) and/or an electromagnetic driver, which may include a solenoid and/or linear motor, generally 114 (FIG. 11), pneumatic cylinder, hydraulic cylinder (neither shown) may be provided for delivering an impulse force that propels the propulsion structure 108' from the armed position to the disarmed position. As shown elsewhere in the drawings, springs 112 are connected to posts 112*a* on support structure upright 104*a* and span between and are connected to posts 112*b* on propulsion structure 108.

The propulsion structure 108 may include a generally arcuate edge portion 124, which is configured to move through a channel 120 (which is connected to support structure 104 in part through flange 105) as the propulsion structure 108 moves between the armed position and the disarmed position. As illustrated in FIG. 1, the propulsion structure 108 may be arranged or configured relative to a projectile engaging portion 164 so as to generally form an L-shape. Channel 120 is elongated and is defined by a channel member 120*a*. Channel 120 may include a friction-inducing and/or resilient surface applied to the floor of channel 120, and may include a pad, or a mat, 120*b* (such as a rubber, vinyl, composite, foam, cushion, and/or other resilient member) positioned in the floor of channel 120 that engages and provides some resistance to the edge 103 of a projectile 102 as projectile 102 is launched from the channel 120 (upon the propulsion structure 108 moving from the armed to the disarmed position). This engagement of edge 103 of projectile 102 with resilient surface or mat 120*b* tends to induce a spin in projectile 102 such that projectile 102 spins in flight, thereby facilitating stabilization of projectile 102 once in flight.

A retainer, generally 128, (FIG. 1) is pivotally connected via pivot 128*a* to upright 104*a* and is provided for selectively retaining the propulsion structure in the armed position. The retainer 128 is configured to pivot about pivot 128*a* to selectively release the propulsion structure 108 from the armed position (via retainer post 128*b* withdrawing from a receptacle 130, as discussed in more detail below), which causes an impulse force to be imparted to propulsion structure 108 due to the force of biasing configuration 110, shown in an example implementation as including spring tension from springs 112.

Retainer 128, when the handle 128*c* thereof is depressed/pivoted downwardly remotely by a user (as limited by stop pin 128*d*) (FIGS. 3 and 4), acts against a spring 128*e*. Spring 128*e* returns retainer 128 to its engagement position after such depression is completed. Spring 128*e*, by maintaining retainer 128 (and thus retainer post 128*b* in the upper position) causes retainer post 128*b* to automatically present itself and to drag against and engage with arcuate edge 124 and receptacles 130 as receptacles 130 contact retainer post 128*b*, upon propulsion structure 108 being moved (against the spring pressure of springs 112) to the armed position. The user may use handle 128*c* to manually select the precise receptacle (130*a*, 130*b*, or 130*c*) to be engaged by handle 128*c*. As shown in FIG. 8, handle 128*c* may be actuated remotely, in an example implementation, by the user utilizing an actuator rod 128*f*.

The arcuate edge 124 defines at least one receptacle 130, which may include first, second, and third receptacles 130*a*, 130*b*, and 130*c*, respectively, that are selectively engaged by the retainer 128 to retain the propulsion structure 108 in the armed position. Multiple receptacles 130 permit selective adjustment of the force by which propulsion structure 108 pushes on projectile 102 in an implementation using springs 112, thereby potentially allowing the distance through which projectile 102 is thrown to be correspondingly adjusted. For example, a greater spring force will be applied to the propulsion structure 108 when the propulsion structure 108 is pivoted to a position where retainer 128 engages receptacle 130*c* than would be the case if the propulsion structure 108 is pivoted to a position where retainer 128 engages receptacle 130*a*.

Turning to FIGS. 1 and 3, the channel 120 has a first portion 136 proximate the propulsion structure 108, when the propulsion structure is in the armed position, and an exit portion 138 distal from the first portion 136. The exit portion 138 is configured to allow the discharge of the projectile 102 from the channel 120 upon the propulsion structure 108 pushing the projectile through the channel 120. The channel 120 is inclined upwardly from the first portion 136 to the second portion thereof with respect to a base 140 of support structure 104, which is shown in a generally horizontal position in FIG. 3.

As shown in FIGS. 9 and 10, a first adjustor 142 is connected to the support structure 104 and is configured to selectively adjust the elevation of the exit portion 138 of the channel 120 above the ground or other surface on which the feet 148 of a tripod, generally 150, (on which support structure 104 is carried). A second adjustor 144 is connected to the support structure 104 and is configured to selectively adjust the position of the exit portion 138 of by allowing movement of the channel through an arc shown by the arrow in FIG. 9. A third adjustor 154 is connected to the support structure and is configured to allow selective adjustment of the position of the exit portion 138 of the channel 120 through an arc shown by the arrow in FIG. 10.

Rotatable threaded adjustors 142, 144, and 154 together thus allow for the exit portion 138 of channel 120 be adjusted and secured in place as desired in the x, y, and z, planes of a Cartesian coordinate system, such planes being generally perpendicular with respect to one another. This allows for the direction in which the projectile 102 is discharged from exit portion 138 to be varied as desired, including downwardly towards the ground, generally straight up, horizontally, and at many other angles and orientations.

As shown in FIG. 7, an elongated holder 160 that carries a plurality of projectiles is detachably connected to the channel 120. Holder 160 is shown in FIG. 7 as being generally perpendicular to channel 120, but it is to be understood that holder 160 could be at an acute angle, an obtuse angle (neither shown), or some other orientation with respect to channel 120, if desired. Channel 120 includes a passage (not shown) that allows the interior of holder 160 to communicate with the interior of channel 120 to thereby allow projectiles 102 to advance from holder 160, under the biasing of a biasing arrangement (such as a spring 162), to a position in biased, or pressing, contact with a projectile engaging portion 164 (FIG. 1) of propulsion structure 108. Holder 160 includes a removable cap 160*a* for allowing access to the interior of holder 160 for loading projectiles 102 therein.

As best shown in FIGS. 1-4 and 12, 12A-12C, a biased engagement member, such as a leaf spring 168, may be provided that releasably engages a projectile 102 in the channel 120 upon the projectile being in biased or pressing contact with the propulsion structure 108. Leaf spring 168 works to retain a projectile in position bearing against projectile engaging portion 164, even if apparatus 100 is moved through various angles and or elevations during use. Although the biased engagement member 168 is shown as being a leaf spring 168, it is to be understood that various other devices and/or configurations (none shown) could be used if desired. Biased engagement member 168 can be attached to channel 120 and may include a nose portion 170 that extends through slot 172 (FIG. 12A) of channel 120 to engage a side of a projectile 102.

Additionally, as shown in FIGS. 13-15, another biased engagement member 178 could also be provided for holding a projectile in position bearing against projectile engaging portion 164 as apparatus 100 is moved to various different positions during use. Biased engagement member 178 could be a leaf spring device attached to propulsion structure 108, and which, as shown in FIG. 14, would engage an edge 103 of a projectile 102 to ultimately, as shown in FIG. 15, bear down on the edge 103 of the projectile 102 to hold projectile 102 against projectile engaging portion 164 of propulsion structure 108 (when propulsion structure 108 is in the armed position).

In operation, apparatus 100 is used to launch a projectile 102, which may include using a method wherein a propulsion structure 108 is pivotally connected to support structure 104, with propulsion structure 108 being movable between an armed position and a disarmed position. The propulsion structure 108 is configured to be in the armed position and projectile 102 is inserted in the channel 120, such that the gravitational pull on the projectile biases and causes the projectile to press against the projectile engaging portion 164 of the propulsion structure 108 (again, upon the propulsion structure being in the armed position). Retainer 128 (which, at this point is engaged in at least one of receptacles 130*a*, 130*b*, and/or 130*c*) is activated such that it disengages from the receptacle(s). This causes biasing configuration 110 (which may include use of spring force from springs 112) to deliver an impulse force that propels the propulsion structure 108 from the armed position to the disarmed position, such that the propulsion structure 108 propels the projectile 102 through the channel 120 and outwardly from the exit portion 138 of channel 120, and into free flight. The direction of the free flight of projectile 102 is determined, at least in part, by the adjustment of the orientation of channel 120 (which, accordingly results in the adjustment of the orientation of exit portion 138) through use of adjusters 142, 144 and/or 154.

Channel 120 is configured, by virtue of its upward incline and the downward gravitational pull on a projectile, to cause the projectile 102 to be in biased or pressing contact with the propulsion structure 108 upon the propulsion structure being in the armed position. Consequently, upon delivery of an impulse force that propels the propulsion structure 108 from the armed position, the propulsion structure 108 propels the projectile 102 through and outwardly from the channel 120. By virtue of the projectile bearing against propulsion structure 108 prior to propulsion structure 108 being released from the armed position, there may be little to no relative movement of propulsion structure 108 with respect to the projectile 102 upon the initiation of movement of the propulsion structure 108 (i.e., when propulsion structure 108 begins its movement from the armed position towards the disarmed position). This results in both the propulsion structure 108 and the projectile moving together as substantially an integral unit at both the initiation of movement of propulsion structure 108 and as propulsion structure 108 pushes projectile 102 through channel 120 until the point where (as propulsion structure 108 moves through its arcuate path) the projectile engagement portion 164 of propulsion structure 108 clears (loses contact with) projectile 102 (which then follows a path generally tangential to the motion of propulsion structure 108). Projectile 102 then ultimately departs channel 120 via exit portion 138 to begin its free flight.

Many modifications and other examples of the disclosure set forth herein will come to mind to those skilled in the art to which this disclosure pertains, having the benefit of the teachings presented in the foregoing descriptions and the associated drawings. Therefore, it is to be understood that the disclosure is not to be limited to the specific examples disclosed and that modifications and other embodiments are intended to be included within the scope of the appended claims.

Moreover, although the foregoing descriptions and the associated drawings describe aspects of the disclosure in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. An apparatus for launching a projectile, the apparatus comprising:

a support structure;

an actuatable retainer;

a propulsion structure pivotally connected to the support structure and movable between an armed position and a disarmed position, the propulsion structure having a projectile engaging portion and an elongated generally arcuate edge portion, the arcuate edge portion extending away from the projectile engaging portion and defining at least a first receptacle and a second receptacle, the first receptacle being configured to selectively engage the retainer to retain the propulsion structure in a first armed position, the second receptacle being configured to selectively engage the retainer to retain the propulsion structure in a second armed position;

means for actuating the propulsion structure from at least one of the first armed position and the second armed position to the disarmed position to deliver an impulse force to the projectile;

a channel configured to cause the projectile to be in biased contact with the projectile engaging portion of the propulsion structure upon the propulsion structure being in at least one of the first armed position and the second armed position, wherein upon the means for actuating the propulsion structure propelling the propulsion structure from at least one of the first armed position and the second armed position, the propulsion structure delivers an impulse to the projectile which propels the projectile through and outwardly from the channel;

wherein the propulsion structure propels the projectile through and outwardly from the channel with greater force from the first armed position than from the second aimed position; and wherein the arcuate edge portion is configured to move through the channel as the propulsion structure moves between at least one of the first armed position and the second armed position and the disarmed position.

2. The apparatus of claim 1, wherein the means for actuating the propulsion structure from at least one of the first armed position and the second armed position to the disarmed position to deliver an impulse force to the projectile includes at least one spring connected to the support structure and the propulsion structure.

3. The apparatus of claim 1, wherein the means for actuating the propulsion structure from at least one of the first armed position and the second armed position to the disarmed position to deliver an impulse force to the projectile includes at least one electromagnetic driver connected to the propulsion structure.

4. The apparatus of claim 1 wherein the at least one retainer is also configured to selectively release the propulsion structure from at least one of the first armed position and the second arm position.

5. The apparatus of claim 1, wherein:

the channel has a first portion proximate the propulsion structure, when the propulsion structure is in at least one of the first armed position and the second armed position, and an exit portion distal from the first portion;

the exit portion is configured to allow the discharge of the projectile from the channel upon the propulsion structure pushing the projectile through the channel; and the channel is inclined upwardly from the first portion to the exit portion thereof with respect to a horizontal plane.

6. The apparatus of claim 5, further comprising:

a first adjustor connected to the support structure configured to selectively move the exit portion of the channel within a first plane;

a second adjustor connected to the support structure configured to selectively move the exit portion of the channel within a second plane, wherein the second plane is generally perpendicular to the first plane; and a third adjustor connected to the support structure configured to selectively move the exit portion of the channel within a third plane, wherein the third plane is generally perpendicular to at least one of the first plane and the second plane.

7. The apparatus of claim 1, further comprising:

a tripod that supports the support structure above a surface.

8. The apparatus of claim 1, further comprising an elongated holder detachably connected to the channel that carries a plurality of projectiles.

9. The apparatus of claim 1, further comprising:

the channel being elongated;

an elongated holder detachably connected to the channel that carries a plurality of projectiles; and the holder extending generally perpendicularly relative to the channel.

10. The apparatus of claim 1, further comprising a biased engagement member that releasably engages a projectile in the channel upon the projectile being in biased contact with the propulsion structure.

11. The apparatus of claim 1, further comprising a biased engagement member connected to the propulsion structure that releasably engages a projectile in the channel upon the projectile being in biased contact with the propulsion structure.

12. The apparatus of claim 1, further comprising a biased engagement member connected to the channel that releasably engages a projectile in the channel upon the projectile being in biased contact with the propulsion structure.

13. The apparatus of claim 1, further comprising the channel including a floor and a resilient mat carried on the floor configured to engage and induce spin in the projectile as the propulsion structure propels the projectile through and outwardly from the channel.

14. A method for launching a projectile, the method comprising:

providing a propulsion structure pivotally connected to a support structure and movable between a first armed position, a second armed position, and a disarmed position, the propulsion structure having a projectile engaging portion and an elongated generally arcuate edge portion, the arcuate edge portion extending away from the projectile engaging portion and defining at least a first receptacle and a second receptacle;

providing a retainer that is actuatable to selectively engage the first receptacle to retain the propulsion structure in the first armed position or to engage the second receptacle to retain the propulsion structure in the second armed position;

configuring the propulsion structure to be in at least one of the first armed position and the second armed position;

actuating the retainer to engage at least one of the first receptacle and the second receptacle;

providing a channel for holding and discharging a projectile from an exit portion of the channel, the arcuate edge portion being configured to move through the channel as the propulsion structure moves between at least one of the first armed position and the second armed position and the disarmed position;

inserting a projectile in the channel;

biasing the projectile against the propulsion structure upon the propulsion structure being in at least one of the first armed position and the second armed position; and actuating the propulsion structure.

15. The method of claim 14, further comprising:

selectively moving the exit portion of the channel within a first plane;

selectively moving the exit portion of the channel within a second plane that is generally perpendicular to the first plane; and selectively moving the exit portion of the channel within a third plane that is generally perpendicular to at least one of the first plane and the second plane.

16. An apparatus for launching a projectile, the apparatus comprising:

a support structure;

a propulsion structure pivotally connected to the support structure and movable between an armed position and a disarmed position;

the propulsion structure having a projectile engaging portion and an elongated generally arcuate edge portion, the arcuate edge portion extending away from the projectile engaging portion and defining at least one receptacle, the projectile engaging portion and the arcuate edge portion generally forming an L-shape;

a retainer that is actuatable to selectively engage the receptacle to retain the propulsion structure in the armed position; and means for actuating the propulsion structure from the armed position to the disarmed position to deliver an impulse force to the projectile;

a channel configured to cause the projectile to be in biased contact with the propulsion structure upon the propulsion structure being in the armed position; and wherein upon the means for actuating the propulsion structure propelling the propulsion structure from the armed position, the propulsion structure delivers an impulse to the projectile which propels the projectile through and outwardly from the channel;

the channel having a first portion proximate the propulsion structure, when the propulsion structure is in the armed position, and an exit portion distal from the first portion;

the exit portion being configured to allow the discharge of the projectile from the channel upon the propulsion structure propelling the projectile through the channel;

the channel being inclined upwardly from the first portion to the exit portion thereof with respect to a horizontal plane;

the arcuate edge portion being configured to move through the channel as the propulsion structure moves between the armed position and the disarmed position.

17. The apparatus of claim 16, further comprising a tripod that supports the support structure above a surface.

18. The apparatus of claim 16 further comprising:

a first adjustor connected to the support structure configured to selectively move the exit portion of the channel within a first plane;

a second adjustor connected to the support structure configured to selectively move the exit portion of the channel within a second plane, wherein the second plane is generally perpendicular to the first plane; and a third adjustor connected to the support structure configured to selectively move the exit portion of the channel within a third plane, wherein the third plane is generally perpendicular to at least one of the first plane and the second plane.

* * * * *